US008033224B1

(12) United States Patent
Yelverton

(10) Patent No.: US 8,033,224 B1
(45) Date of Patent: Oct. 11, 2011

(54) SPIRAL LINEAR SHAPED CHARGE JET

(75) Inventor: John W. Yelverton, Port Walton Beach, FL (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 304 days.

(21) Appl. No.: 12/409,586

(22) Filed: Mar. 24, 2009

(51) Int. Cl.
*F42B 10/00* (2006.01)

(52) U.S. Cl. ..... 102/476; 102/306; 102/307; 102/308; 102/309; 102/310; 102/481

(58) Field of Classification Search ..... 102/306–310, 102/476, 481
See application file for complete search history.

(56) References Cited

U.S. PATENT DOCUMENTS

| | | | | | |
|---|---|---|---|---|---|
| 3,636,875 | A * | 1/1972 | Dodson | ..... | 102/310 |
| 3,724,372 | A * | 4/1973 | Phillips | ..... | 102/364 |
| 4,823,700 | A * | 4/1989 | Alker et al. | ..... | 102/476 |
| 5,551,346 | A * | 9/1996 | Walters et al. | ..... | 102/476 |
| 5,698,814 | A * | 12/1997 | Parsons et al. | ..... | 102/478 |
| 6,179,944 | B1 * | 1/2001 | Monolo et al. | ..... | 156/169 |
| 6,283,036 | B1 * | 9/2001 | Munsinger | ..... | 102/479 |
| 7,299,735 | B2 | 11/2007 | Alford | | |
| 7,393,423 | B2 | 7/2008 | Liu | | |
| 2001/0052303 | A1 | 12/2001 | Mayseless et al. | | |
| 2002/0083860 | A1 * | 7/2002 | Shim | ..... | 102/306 |
| 2005/0056459 | A1 | 3/2005 | Haney et al. | | |
| 2006/0201371 | A1 * | 9/2006 | Li et al. | ..... | 102/307 |
| 2006/0243153 | A1 | 11/2006 | Skinner et al. | | |
| 2006/0254452 | A1 * | 11/2006 | Hunn et al. | ..... | 102/481 |
| 2008/0202755 | A1 | 8/2008 | Henke et al. | | |

* cited by examiner

*Primary Examiner* — Michael Carone
*Assistant Examiner* — Samir Abdosh
(74) *Attorney, Agent, or Firm* — AFMCLO/JAZ; Daniel J. Krieger

(57) ABSTRACT

The invention represents a novel system for controlling the yield of an explosive charge that enables the explosive yield to be selected or decreased from full-yield detonation incrementally down to low-yield detonation using a continuous linear shaped charge jet spiraled around the main charge explosive and deflagrating a selected portion of the main charge explosive. The spiral linear shaped charge jet initiation system activates and projects a liner in a radial direction across a diameter of the main charge explosive in a spiral around its axis at a preselected deflagration velocity toward a main-charge detonation shock front reducing the main charge explosive.

12 Claims, 4 Drawing Sheets

SPIRAL LINEAR SHAPED CHARGE JET

RIGHTS OF THE GOVERNMENT

The invention described herein may be manufactured and used by or for the Government of the United States for all governmental purposes without the payment of any royalty.

BACKGROUND OF THE INVENTION

The invention relates to selectable-yield munitions and more specifically to spiral linear shaped charge jets.

Explosive ordnance is defined as any component or assembly that contains or is operated by explosive materials. The ability to rapidly release directed energy to perform multiple operations nearly simultaneously is the major attribute of explosive ordnance. To be useful in the aerospace industries and other industries, explosive components' output must be controlled. Selectable-yield munitions have been identified by United States Department of Defense planners as a means to reduce collateral damage while optimizing lethality against a broad target set. Explosively actuated devices are generally lighter and smaller than equivalent mechanical or electromechanical devices, which makes them attractive for space applications. Typical tasks include launch vehicle hold-down release, engine ignition, stage separation, fairing separation, and appendage deployment. In the military sector, multiple inventory weapons—ranging from concrete-filled bombs to 250-lb, 500-lb, 1000-lb, and 2000-lb general purpose bombs—could be replaced by a single selectable-yield munition.

One method of controlling, or selecting, the yield of munitions that has received a great deal of attention is the use of shaped charge jets (SCJ's) to deflagrate (burn) a portion of the main charge explosive to reduce the overall yield prior to a the main charge being detonated. This is accomplished by detonating the explosive within the shaped charge jet, which causes the shaped charge jet liner to form a high velocity jet. The jet formed from the liner penetrates the main charge explosive. The high pressure, temperature, and friction induced on the main charge from the jet causes the main charge explosive to burn. The reaction induced by the shaped charge jet must be kept below the minimum pressure and temperature reaction threshold, specific to the explosive being used in the main charge, which would lead to detonation of the main charge through a shock to detonation or deflagration to detonation reaction. Current state-of-the-art shaped charge jet fabrication techniques and knowledge of explosive initiation properties has enabled shaped charge jets to be optimized to great extent for deflagrating explosives without causing a transition to detonation.

The rate at which the mass of the explosive is reduced by the deflagration reaction is highly dependent on the initial surface area affected by the jet. For a conical shaped charge jet, the initial reacted area is mostly limited to the single axis path of the jet, i.e., similar to path of a bullet through the charge. For linear shaped charge jet, the initial reacted area is limited to the cross-sectional plane of which the jet cuts through the explosive, i.e., similar to a knife blade cutting through the charge. In both cases the volume affected by a single shaped charge jet is very limited, and the reaction time is unsuitable for most military applications where a dial-a-yield capability would be useful. For example, a free fall general purpose bomb traveling at 1000 feet per second will move 1 foot per millisecond. Therefore, control of the yield would need to be within a few milliseconds to effectively attack a target once the target detection device trigger threshold is met for weapon initiation. This is well beyond the deflagration rate attainable with a single conical or linear shaped charge jet. Therefore, a large number of conical or linear shaped charge jets using current state-of-the-art design techniques would be required to precisely control the yield of a large explosive volume, i.e., net explosive weight, weapon over the potential range of outputs from high-order detonation to full low-yield deflagration on a time scale that is suitable for many military target engagements.

SUMMARY OF THE INVENTION

The invention represents a novel system for controlling the yield of an explosive charge that enables the explosive yield to be selected or decreased from full-yield detonation incrementally down to low-yield detonation using a continuous linear shaped charge jet spiraled around the main charge explosive and deflagrating a selected portion of the main charge explosive.

It is therefore an object of the present invention to provide a system for controlling the yield of an explosive charge.

It is another object of the invention to provide a system for controlling the yield of an explosive charge that enables the explosive yield to be selected or decreased from full-yield detonation incrementally down to low-yield detonation.

It is another object of the invention to provide a system for controlling the yield of an explosive charge that enables the explosive yield to be selected or decreased from full-yield detonation incrementally down to low-yield detonation using a continuous linear shaped charge jet spiraled around the main charge explosive and deflagrating a selected portion of the main charge explosive.

These and other objects of the invention are achieved by the description, claims and accompanying drawings and by a system for controlling a yield of an explosive charge comprising:

a charge case wall;

a main charge explosive within said charge case wall;

a spiral linear shaped charge jet having a liner mounted to said charge case wall herein said liner coils around said main charge explosive;

a time variable spiral linear shaped charge jet initiation system connected to said spiral linear shaped charge jet at one end of said charge case wall; and a main charge explosive detonation system at a second end of said charge case, said second end in opposing alignment to said first end;

said spiral linear shaped charge jet initiation system activated and projecting said liner in a radial direction across a diameter of said main charge explosive in a spiral around its axis at a preselected deflagration velocity toward a main-charge detonation shock front reducing said explosive yield by an amount proportional to the volume of explosive deflagrated at a preselected time when the detonated shock front reaches a deflagration interface.

DETAILED DESCRIPTION

Figures 1A, 1B, 1C:
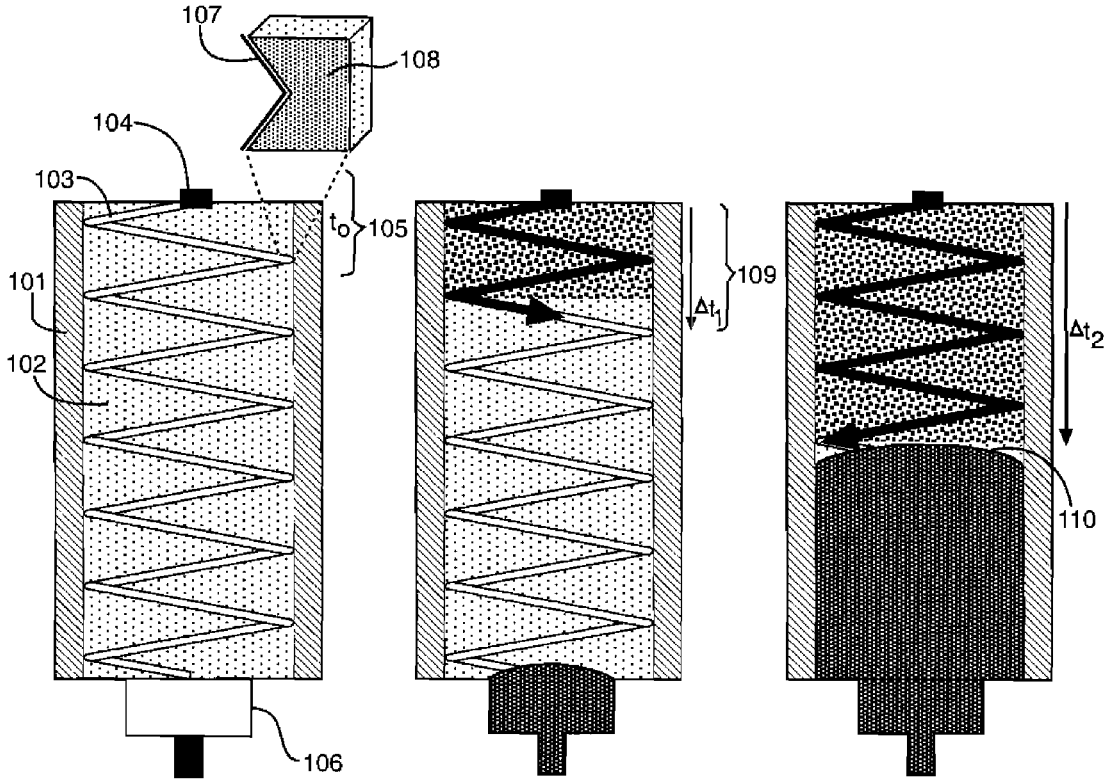
FIG. 1*a* illustrates an inner diameter case mounted spiral linear shaped charge jet initiated at $t_0$.
FIG. 1*b* illustrates an inner diameter case mounted spiral linear shaped charge jet initiated at $\Delta t_1$.
FIG. 1*c* illustrates an inner diameter case mounted spiral linear shaped charge jet initiated at $\Delta t_2$.

The system for controlling the yield of an explosive charge described and disclosed herein uses a linear shaped charge jet spiraled around the main-charge of the explosive warhead with liner positioned to shoot across the diameter of the main charge for controlling the yield of an explosive charge. FIGS. 1*a*-1*c* shows a drawing of a spiral linear shaped charge jet according to the arrangement of the invention. The main charge case wall is shown at 101 and the main charge within the wall is shown at 102. The spiral linear shaped charge jet is shown at 103 and the spiral linear shaped charge jet initiation system is shown at 104. The main charge detonation system is shown at 106. A magnified view of the spiral linear shaped charge jets' liner interfacing with the explosive is shown at 107 and at 108, respectively.

The system is initiated at $t_0$, shown at 105, which produces a deflagration reaction along the radial path of the jet through the main-charge 102. FIG. 1*b* shows the main charge explosive detonated at $\Delta t_1$ and progresses toward the advancing spiral shaped linear charge shaped jet deflagrator interface. FIG. 1*c* shows the detonating main charge shock front reaching the deflagration interface 110 at $\Delta t_2$. FIGS. 1*a*-1*c* show that the explosive yield is reduced by an amount proportional to the volume of explosive deflagrated at the time, $\Delta t_2$, at which the detonated shock front reaches the deflagration interface.

Because the rate at which the mass of the main explosive is reduced by the deflagration reaction is highly dependent on the initial surface area affected by the jet, the output from the spiral linear shaped charge jet liner and coil ratio, i.e., number of revolutions per unit length along the axis, are chosen to maximize the deflagration rate of the warhead while remaining below the critical initiation parameters that would lead to a transition to detonation of the main-charge. Furthermore, the angle of the jet's path, i.e., the vector between the axial and radial coordinates, can also be tailored for maximum surface area by positioning the liner to shoot across the diameter of the main charge at an angle opposite to the axial direction at which spiral linear shaped charge jet explosive propagates. This may both increase surface area affected by the jet and reduce the volume of unreached explosive that could deflagrate to detonation.

Figures 2A, 2B, 2C:
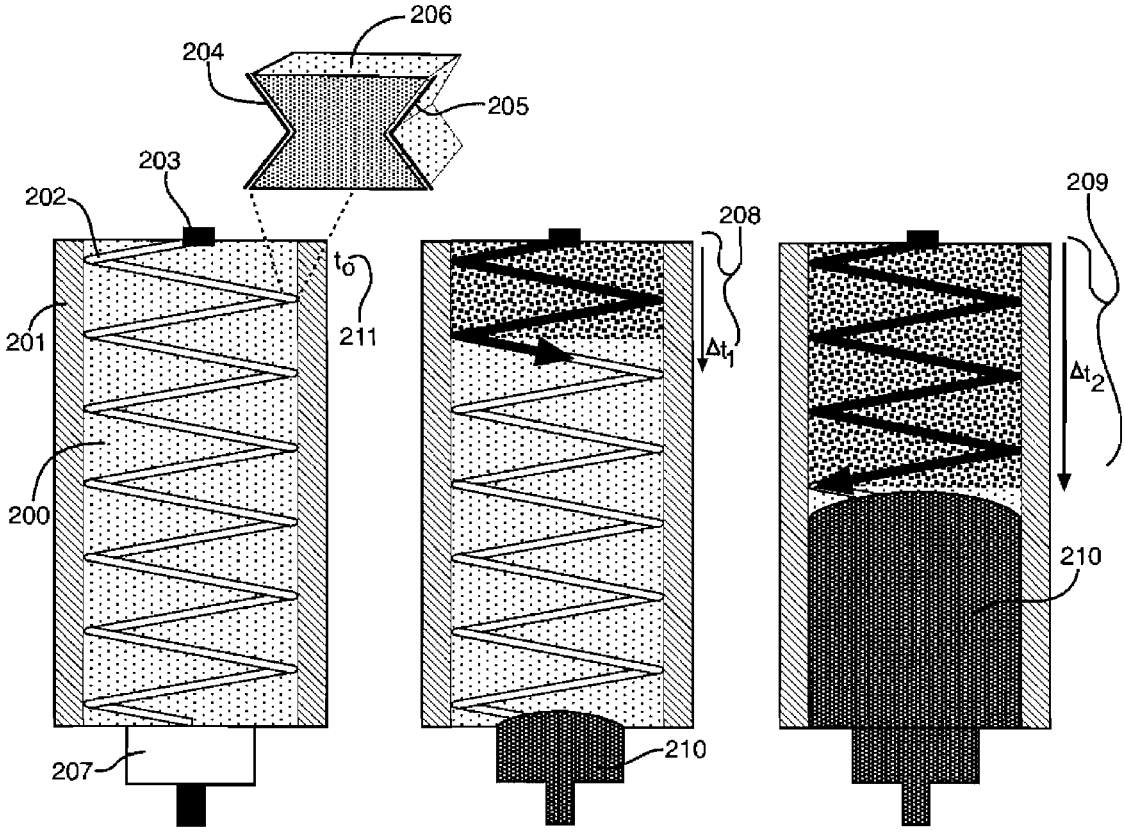
FIG. 2*a* illustrates an inner diameter case mounted double sided spiral linear shaped charge jet at $t_0$.
FIG. 2*b* illustrates an inner diameter case mounted double sided spiral linear shaped charge jet at $\Delta t_1$.
FIG. 2*c* illustrates an inner diameter case mounted double sided spiral linear shaped charge jet at $\Delta t_2$.
Figures 3A, 3B, 3C:
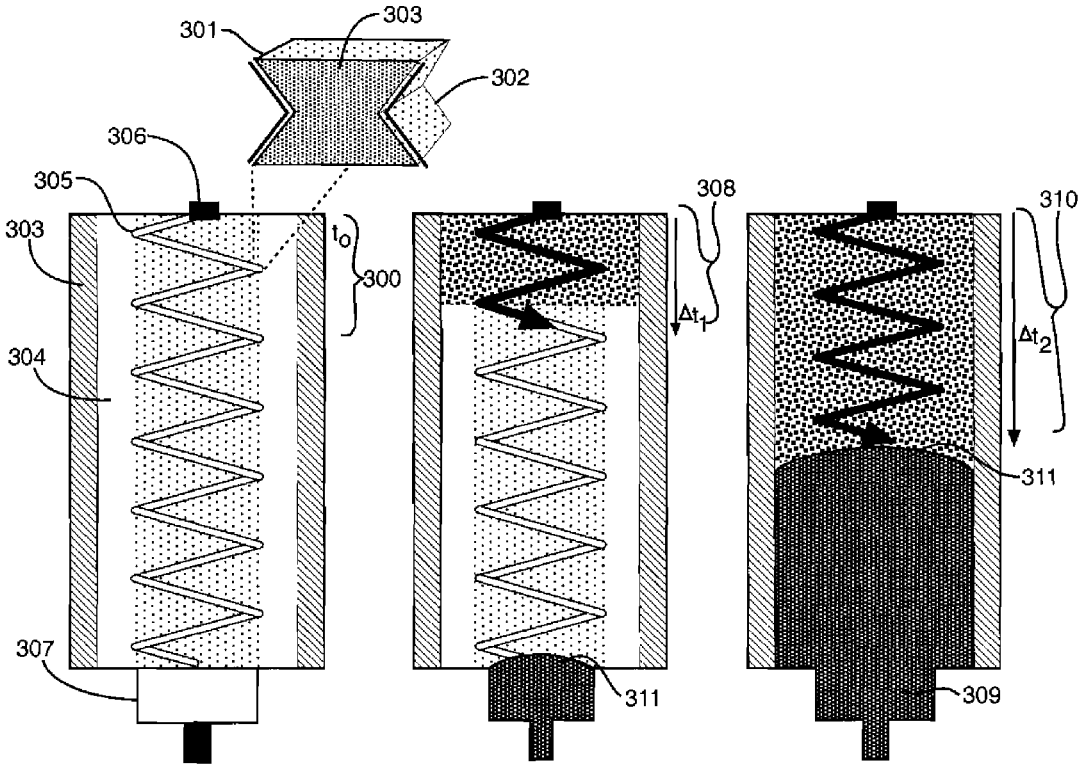
FIG. 3*a* illustrates a core mounted double sided spiral linear shaped charge jet at $t_0$.
FIG. 3*b* illustrates a core mounted double sided spiral linear shaped charge jet at $\Delta t_1$.
FIG. 3*c* illustrates a core mounted double sided spiral linear shaped charge jet at $\Delta t_2$.

Depending on the requirements of the application, the spiral linear shaped charge jet can be positioned along the inner diameter (ID), of the main-charge casing, as is shown in FIGS. 1*a*-1*c* and in FIGS. 2*a*-2*c*, which shows an inner diameter mounted double-sided spiral linear shaped charge jet. In further arrangements of the invention, the spiral linear shaped charge jet could be mounted in the core of the main charge, as illustrated in FIGS. 3*a*-3*c* which show a core mounted double-sided spiral linear shaped charge jet or along the outer diameter (OD) of the main charge casing, illustrated in FIGS. 4*a*-4*c*, to deflagrate the explosive and tailor the case fragmentation produced.

FIGS. 2*a*-2*c* show a spiral linear shaped charge jet initiation system for controlling the yield of an explosive charge. Similar to FIGS. 1*a*-1*c*, the main charge is shown at 200, the main charge case wall is shown at 201, the spiral linear shaped charge jet is shown at 202, the spiral linear shaped charge jet initiation system is shown at 203 and the main charge detonation system is shown at 207. In an expanded view, the deflagration spiral linear shaped liner is shown at 204 with the spiral linear shaped charge jet explosive at 206 and at case cutting liner shown at 205. The case cutting liner is explosively formed into a high speed metal jet similar to the deflagration liner; however, it is positioned to shoot toward the main charge case. The choice of the case cutting liner material, e.g., copper, aluminum, etc., and physical dimensions such as thickness, are tailored specifically to the requirements to cut the main charge case. Cutting the case serves two functions: (1) the deflagration gas products can be vented to prevent uncontrolled rupturing of the main charge case prior to the detonation front reaction reaching the deflagration front reaction, (2) the portion of the case near the deflagration reaction may be kept in one piece, which will limit collateral damage by reducing the probability of hit. FIG. 2*a* shows the spiral linear shaped charge jet initiated at time $t_0$ at 211, which produces a deflagration reaction along the radial path of the jet through the main-charge. FIG. 2*b* shows the main charge explosive detonated at $\Delta t_1$ and progresses toward the advancing spiral linear shaped charge jet deflagrator interface 210. Finally, FIG. 2*c* shows the detonating main charge shock front reaching the deflagration interface at $\Delta t_2$ shown at 209. In FIGS. 2*a*-2*c* the explosive yield is reduced by an amount proportional to the volume of explosive deflagrated at the time at which the detonation shock front reaches the deflagration interface.

Another possible configuration of the invention is a core mounted double-sided linear shaped charge jet. This preferred arrangement of the invention is illustrated in FIGS. 3*a*-3*c*. As similarly described in the previous figures, the main charge case wall is shown at 303, the main charge is shown at 304, the spiral linear shaped charge jet is shown at 305 and the associated initiation system is shown at 306. The main charge detonation system is shown at 307 and a magnified view of the inner deflagration liner 301 and outer liner 302 is also shown relative to the spiral linear shaped charge jet explosive 303. The explosive charge is shown initiated at 300 $t_0$ which produces a deflagration reaction in both the inner and outer radial paths from the corresponding deflagration liners. FIG. 3*b* shows the main charge explosive detonated at $\Delta t_1$ and progresses toward the advancing spiral linear shaped charge jet deflagrator interface 311 and FIG. 3*c* shows the detonating main charge shock front 309 reaching the deflagration interface at 311. In FIGS. 3*a*-3*c* the explosive yields are reduced by an amount proportional to the volume of explosive deflagrated at the time at which the detonated shock front reaches the deflagration interface. In some designs the outer liner may be used for both deflagrating the explosive and cutting/scoring the case.

Figures 4A, 4B, 4C:
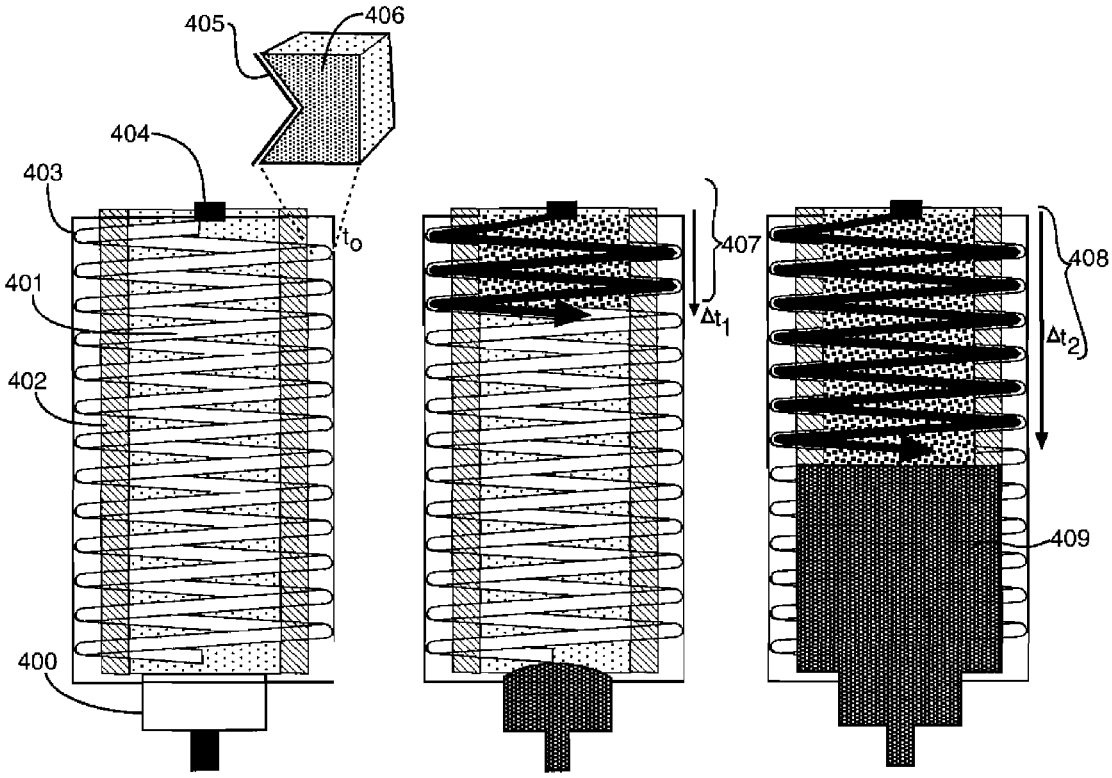
FIG. 4*a* illustrates an outer diameter case mounted spiral linear shaped charge jet at $t_0$.
FIG. 4*b* illustrates an outer diameter case mounted spiral linear shaped charge jet at $\Delta t_1$.
FIG. 4*c* illustrates an outer diameter case mounted spiral linear shaped charge jet at $\Delta t_2$.

FIGS. 4*a*-4*c* illustrate an outer diameter case mounted spiral linear shaped charge jet. The main charge case wall is shown at 402, the main charge is shown at 401, the spiral linear shaped charge jet is shown at 403, the spiral linear shaped charge jet initiation system is shown at 404, the main charge detonation system is shown at 400 and an expanded view of a portion of the spiral linear shaped charge jet liner and explosive are shown at 405 and 406, respectively. In the case of an outer diameter positioned spiral linear shaped charge jet as illustrated in FIGS. 4*a*-4*c*, the jet 403 penetrates (i.e., cuts through) the main-charge casing 402 material first, which can additionally be used to tailor the case fragments produced as well as control venting of the deflagration products. Once initiated, the liner of the spiral linear shaped charge jet is projected in a radial direction across the diameter of the main-charge 401, illustrated at 407 in FIG. 4*b*, at several km/s while propagating in a spiral around its axis at a detonation velocity typically around 7 km/s toward the main charge detonation source 409. FIG. 4*b* shows the main charge explosive detonating at $\Delta t_1$ and progressing toward the advancing spiral linear shaped charge jet deflagrator interface and finally at 408 in FIG. 4*c* the detonating main charge shock front reaches the deflagration interface at $\Delta t_2$. In FIGS. 4*a*-4*c* the explosive yield is reduced by an amount proportional to the volume of explosive deflagrated at the time at which the detonation shock front 409 reaches the deflagration interface.

Depending on the warhead and overall system design constraints, one of the four configurations shown may be more useful than the others for controlling the yield of the weapon. The most significant difference of the preferred arrangements of the invention described and disclosed herein is between those that cut the case to provide additional venting of the deflagration gas products, as shown in FIGS. 2*a*-2*c*, 4*a*-4*c* and potentially in FIGS. 3*a*-3*c*, and the configuration shown in FIG. 1 which does not cut the main charge case. The configuration shown in FIGS. 3*a*-3*c* is unique in that, depending on the system requirements, it could be configured to either cut or not cut through the main charge case wall. This concept may be easier to manufacture and use in warhead cases that are not perfect cylinders, e.g., MK-82 bomb case. Although the concept shown in FIGS. 4*a*-4*c* uses a single-sided linear shaped charge jet to both cut the main charge case and deflagrate the main charge explosive, which may limit the design complexity; it may be impractical if trying to retrofit an existing warhead case design without changing the outer physical dimensions, e.g. MK-82 bomb. Similarly, the single-sided spiral linear shaped charge jet shown in FIGS. 1*a*-1*c* may be easier to manufacture than a double-sided spiral linear shaped charge jet, but may not provide sufficient venting.

The preferred arrangements of the present invention are an improvement over the prior art in several aspects. Because of the continuous axial progression of the spiral linear shaped charge jet deflagrator design described, only two initiation points are required in most cases to alter the yield in a continuous range from full-yield detonation to a low-yield deflagration of the main-charge. One initiation point starts the detonation of the spiral linear shaped charge jet which propagates toward the second initiation point. The second initiation point starts the detonation reaction in the main charge that propagates in the opposite direction as the spiral linear shaped charge jet, which causes the two main charge reaction fronts, deflagration and detonation, to meet. Only two initiation points significantly reduce the complexity and cost of implementing a selectable-yield explosive warhead. Additionally, because the deflagration reaction can be propagated at several km/s along the axis and diameter covering a significant amount of the main-charge volume, the spiral linear shaped charge jet technology can be used to control the yield of larger net explosive weight weapons, such as bombs and missiles, on a time scale that is suitable for most target engagement velocities without the need for controlling the timing of more than two initiation points. For certain high-speed weapon applications where the yield control timing of a single point initiated spiral linear shaped charge jet is insufficient to produce the desired warhead effect, the use of more than one spiral linear shaped charge jet along the axis of the warhead or more than one initiation point along the length of the spiral linear shaped charge jet may also be used to further reduce the yield control timing.

While the apparatus and method herein described constitute a preferred embodiment of the invention, it is to be understood that the invention is not limited to this precise form of apparatus or method and that changes may be made therein without departing from the scope of the invention which is defined in the appended claims.

What is claimed is:

1. A system for controlling a yield of an explosive charge comprising:

a charge case wall;

a main charge explosive within said charge case wall;

a double-sided spiral linear shaped charge jet mounted to said charge case wall comprising:

a deflagration liner coiled around said main charge explosive;

a case cutting liner positioned to shoot toward said main charge case;

a time variable spiral linear shaped charge jet initiation system connected to said spiral linear shaped charge jet at one end of said charge case wall; and a main charge explosive detonation system at a second end of said charge case, said second end in opposing alignment to said first end;

said spiral linear shaped charge jet initiation system activated and projecting said deflagration liner in a radial direction across a diameter of said main charge explosive in a spiral around its axis at a preselected deflagration velocity and projecting said case cutting liner toward said main charge case for cutting said charge case wall and venting deflagration gas products, said spiral linear shaped charge jet advancing toward a main-charge detonation shock front thereby reducing said explosive yield by an amount proportional to the volume of explosive deflagrated at a preselected time when the detonated shock front reaches a deflagration interface.

2. The system of claim 1 for controlling a yield of an explosive charge wherein said case cutting liner is comprised of copper.

3. The system of claim 1 for controlling a yield of an explosive charge wherein said deflagration liner coiled around said main charge explosive further comprises a deflagration liner coiled at a preselected number of revolutions per minute around said main charge explosive thereby maximizing deflagration rate of said main charge explosive.

4. The system of claim 1 for controlling a yield of an explosive charge wherein said double sided spiral linear shaped charge jet mounted to said charge case wall is mounted to an inner diameter of said charge case wall.

5. The system of claim 1 for controlling a yield of an explosive charge wherein said spiral linear shaped charge jet projects in a radial direction across a diameter of said main charge explosive in a spiral around its axis at a preselected detonation velocity of 7 km/s.

6. The system of claim 1 for controlling a yield of an explosive charge wherein said charge case wall further comprises a charge case wall of a large net explosive weapon.

7. A method for controlling a yield of an explosive charge comprising the steps of:

providing a main charge explosive within a charge case wall;

mounting to said charge case wall a double-sided spiral linear shaped charge jet;

initiating a spiral linear shaped charge jet having a deflagrating liner and a case cutting liner;

deflagrating a preselected portion of said main charge explosive using said deflagration liner forming a high speed jet upon initiating and;

cutting said charge case wall for venting deflagrating gas products using said case cutting liner forming a high speed metal jet upon initiating;

initiating detonation of said main charge explosive at an opposing aligned end of said initiating of said spiral linear shaped charge jet;

said spiral linear shaped charge jet advancing toward a main-charge detonation shock front thereby reducing said explosive yield by an amount proportional to the volume of explosive deflagrated at a preselected time when said detonated shock front reaches a deflagration interface.

8. The method for controlling a yield of an explosive charge of claim 7 wherein said mounting step further comprises mounting to an inner diameter of said charge case wall a double-sided spiral linear shaped charge jet.

9. The method for controlling a yield of an explosive charge of claim 7 wherein said deflagrating step further comprises deflagrating a preselected portion of said main charge explosive across the diameter of said main charge at an angle opposite to an axial direction at which said spiral linear shaped charge jet propagates.

10. The method for controlling a yield of an explosive charge of claim 7 wherein said initiating step further comprises initiating a spiral linear shaped charge coiled at a preselected number of revolutions per minute around said main charge explosive thereby maximizing deflagration rate of said main charge explosive.

11. The method for controlling a yield of an explosive charge of claim 7 wherein said providing step further comprises providing a main charge explosive within a charge case wall of a large net explosive weapon.

12. The method for controlling a yield of an explosive charge of claim 7 wherein said deflagrating step further comprises deflagrating a preselected portion of said main charge explosive using said deflagration liner forming a high speed jet projecting in a radial direction across a diameter of said main charge explosive in a spiral around its axis at a preselected detonation velocity of 7 km/s.

* * * * *